US005139438A

United States Patent [19]

Gaffney

[11] Patent Number: 5,139,438

[45] Date of Patent: Aug. 18, 1992

[54] EXTENSION CORD RECEPTACLE

[76] Inventor: Daniel P. Gaffney, 1063 CR 301, Durango, Colo. 81301

[21] Appl. No.: 742,376

[22] Filed: Aug. 8, 1991

[51] Int. Cl.[5] ..... H01R 11/22

[52] U.S. Cl. ..... 439/269; 439/592

[58] Field of Search ..... 439/269, 369, 502, 266, 439/505, 586, 506, 370, 592

[56] References Cited

U.S. PATENT DOCUMENTS 2,748,362 5/1956 Andis ..... 439/269
2,915,732 12/1959 Pifer ..... 439/592
2,962,687 11/1960 Fickbohm ..... 439/269

FOREIGN PATENT DOCUMENTS 1365196 1/1988 U.S.S.R. .

*Primary Examiner*—Larry I. Schwartz
*Assistant Examiner*—Khiem Nguyen
*Attorney, Agent, or Firm*—Leon Gilden

[57] ABSTRACT

A receptacle for use with an extension cord and an electrical plug member is formed of a generally "Y" shaped configuration, with a receiving channel directed interiorly of each leg of the "Y" shaped housing, with the legs of the housing biased in a separated position relative to one another, with a central "T" shaped rib positioned medially of the housing legs. The medially positioned rib includes a rib leg of planar sides to accommodate the housing legs when the housing legs are directed towards one another to accommodate a receptacle, wherein the housing legs upon release are biased in a separated orientation to engage and lock an electrical plug member within the housing.

1 Claim, 4 Drawing Sheets

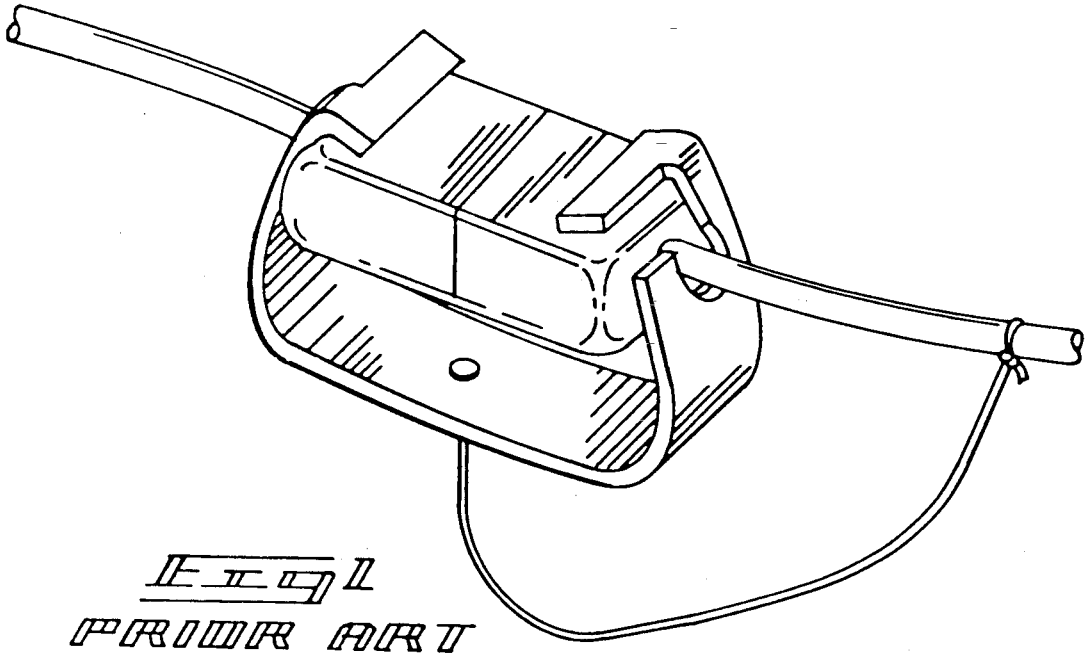
Fig 1
PRIOR ART
Fig 2
PRIOR ART
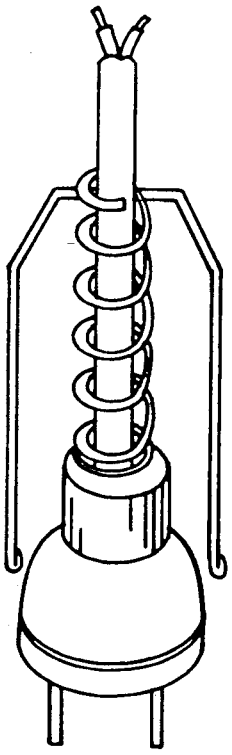

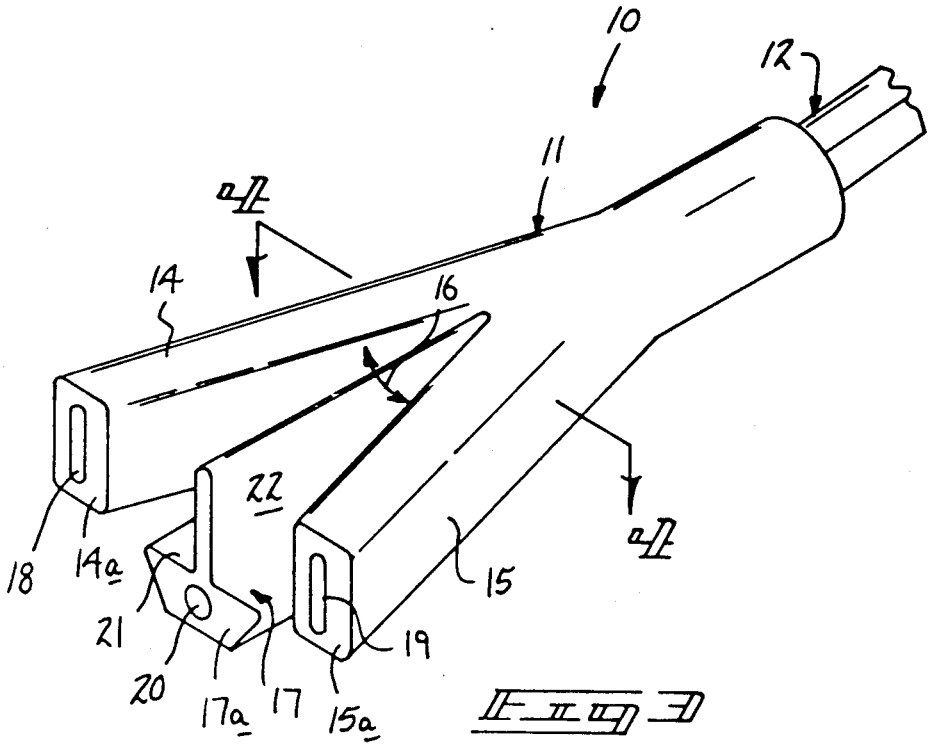
Fig 3
Fig 4
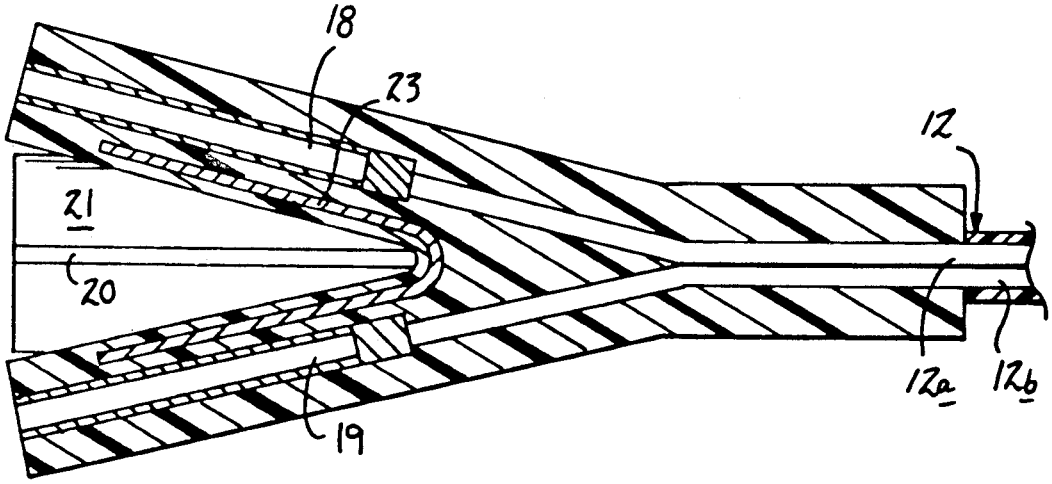

Fig 7
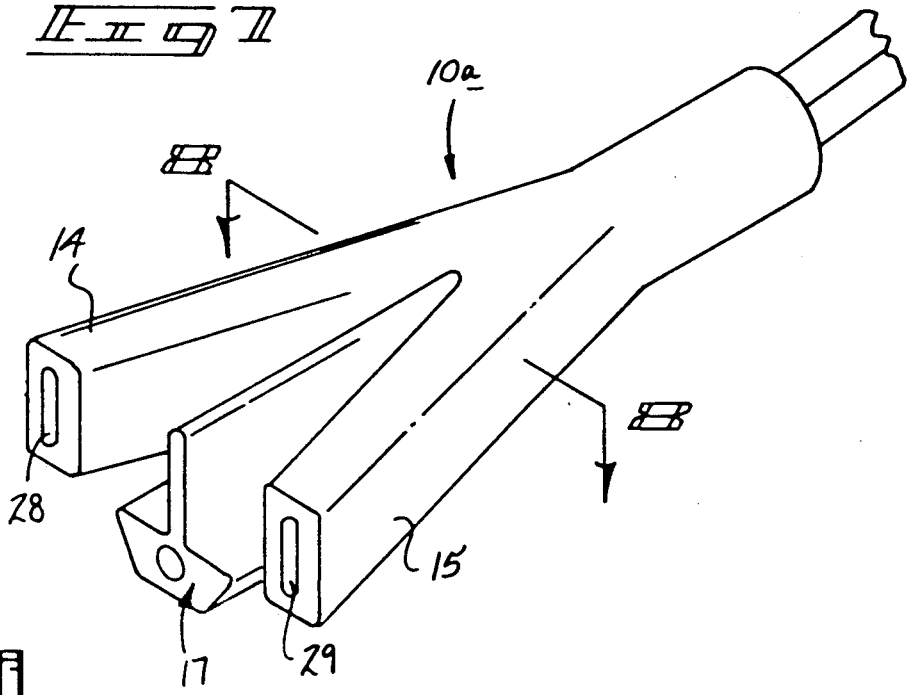
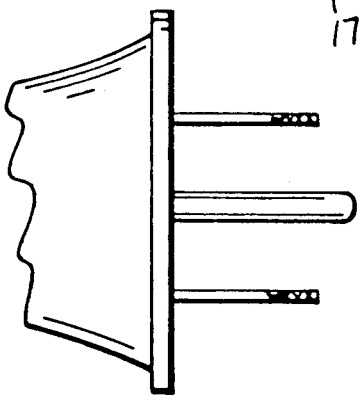
Fig 9
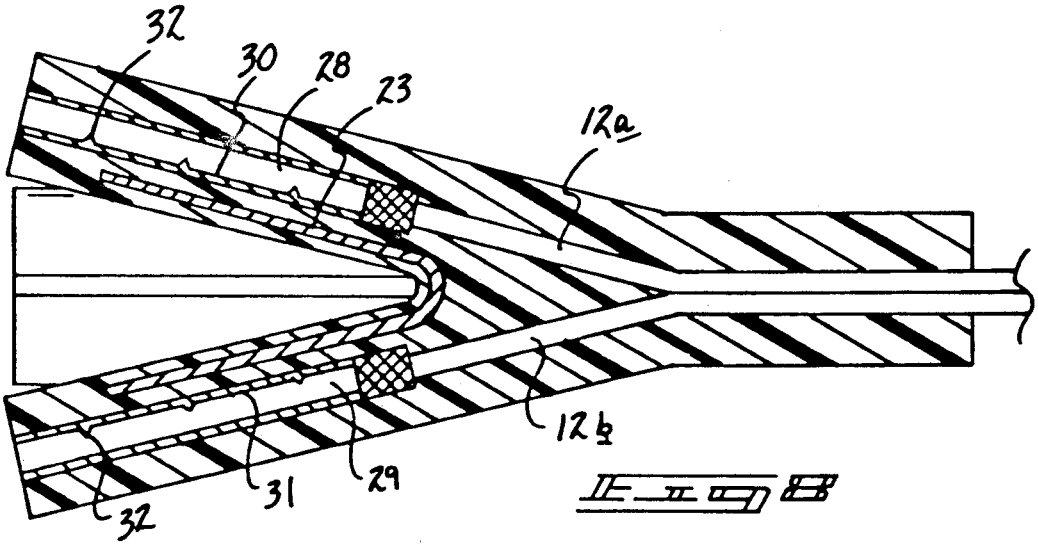
Fig 8

EXTENSION CORD RECEPTACLE

BACKGROUND OF THE INVENTION

1. Field of the Invention

The field of invention relates to receptacle apparatus, and more particularly pertains to a new and improved extension cord receptacle wherein the same is arranged for the locking of an electrical plug relative to a receptacle.

2. Description of the Prior Art

Various appliances are mounted to mate an electrical plug into a socket. The typical male plug includes a plurality of connecting prongs and typically a grounding prong. Various apparatus has been utilized in the prior art to maintain electrical communication and mechanical engagement with the male plug and the socket to secure their interconnection for continued use of the associated appliance. Prior art apparatus in this regard is exemplified in U.S. Pat. No. 4,544,216 to Imahoff wherein a grounding prong on a male portion of the plug is a "V" or "U" shaped cross-section to enhance engagement of the plug and socket together.

U.S. Pat. No. 4,623,209 to Mangone sets forth a safety female plug connector utilizing biased leg members to enhance engagement of utilizing a plug and socket.

U.S. Pat. No. 3,097,034 to Jamrosy sets forth a plurality of legs mounted about an extension cord to enhance engagement of the associated socket to a female plug utilizing a complementarily configured plurality of such legs.

U.S. Pat. No. 4,773,874 to Kopesky, Jr. sets forth a power cord clip defining a generally "U" shaped bracket to insert a male and female plug therewithin for their continued interengagement.

As such, it may be appreciated that there continues to be a need for a new and improved extension cord receptacle as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of receptacle apparatus now present in the prior art, the present invention provides an extension cord receptacle wherein the same is arranged to provide for spring biased legs to frictionally and mechanically secure a male plug within the associated socket structure. As such, the general purpose of the present invention, which will be described subsequently in greater detail, is to provide a new and improved extension cord receptacle which has all the advantages of the prior art receptacle apparatus and none of the disadvantages.

To attain this, the present invention provides a receptacle for use with an extension cord and an electrical plug member formed of a generally "Y" shaped configuration, with a receiving channel directed interiorly of each leg of the "Y" shaped housing, with the legs of the housing biased in a separated position relative to one another, with a central "T" shaped rib positioned medially of the housing legs. The medially positioned rib includes a rib leg of planar sides to accommodate the housing legs when the housing legs are directed towards one another to accommodate a receptacle, wherein the housing legs upon release are biased in a separated orientation to engage and lock an electrical plug member within the housing.

My invention resides not in any of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved extension cord receptacle which has all the advantages of the prior art receptacle apparatus and none of the disadvantages.

It is another object of the present invention to provide a new and improved extension cord receptacle which may be easily and efficiently manufactured and marketed.

It is a further object of the present invention to provide a new and improved extension cord receptacle which is of a durable and reliable construction.

An even further object of the present invention is to provide a new and improved extension cord receptacle which is susceptible of a low cost of manufacture with regard to both materials and labor, and which accordingly is then susceptible of low prices of sale to the consuming public, thereby making such extension cord receptacle economically available to the buying public.

Still yet another object of the present invention is to provide a new and improved extension cord receptacle which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art receptacle locking apparatus.

FIG. 2 is an isometric illustration of a further example of a prior art receptacle and male plug locking apparatus.

FIG. 3 is an isometric illustration of the instant invention.

FIG. 4 is an orthographic view, taken along the lines 4—4 of FIG. 3 in the direction indicated by the arrows.

FIG. 7 is an isometric illustration of a modified receptacle apparatus as set forth by the instant invention.

FIG. 8 is an orthographic view, taken along the lines 8—8 of FIG. 7 in the direction indicated by the arrows.

FIG. 9 is an orthographic to view of a modified plug member utilized by the invention.

DESCRIPTION OF THE PREFERRED EMBODIMENT

Figure 5:
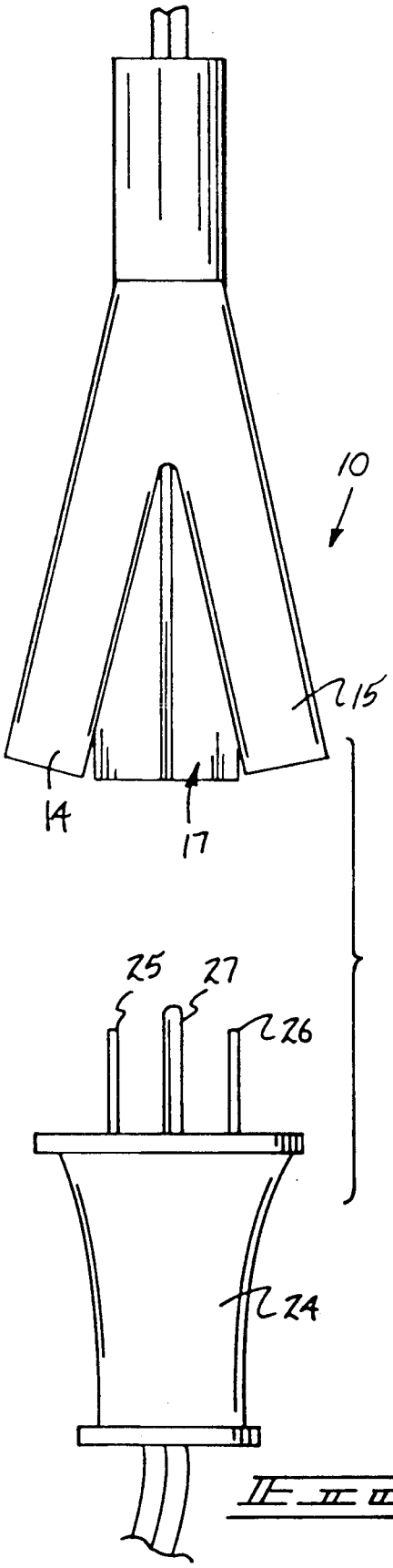
FIG. 5 is an orthographic top view of the invention in a first position.

With reference now to the drawings, and in particular to FIGS. 1 to 9 thereof, a new and improved extension cord receptacle embodying the principles and concepts of the present invention and generally designated by the reference numerals 10 and 10*a* will be described.

FIG. 1 illustrates a prior art structure, as set forth in U.S. Pat. No. 4,773,874 wherein a generally "U" shaped bracket includes slots to receive power cords at upper ends thereof to secure a socket and plug member together.

FIG. 2 illustrates a further prior art structure as set forth in U.S. Pat. No. 3,097,034 wherein the parallel leg structure, as illustrated, biased rearwardly of the associated male socket is coupled to an identical leg structure about a female socket to secure the plug and socket together.

More specifically, the extension cord receptacle 10 of the instant invention essentially comprises a unitary generally "Y" shaped socket housing 11, including an electrical transmission line 12 mounted thereto, to include a first and second electrical cable 12*a* and 12*b* contained therewithin (see FIG. 4). If necessary, a ground or third cable may be employed in a conventional manner. The housing 11 includes a cylindrical housing shank 13 mounting a respective first and second flexible housing leg 14 and 15, with each leg formed of a memory retentent material to normally maintain and bias the first and second housing legs 14 and 15 in a separated orientation, as illustrated in FIG. 3. Each housing leg 14 and 15 includes a respective first and second end wall 14*a* and 15*a*, as illustrated. An acute included angle 16 is defined between interior walls of the housing legs 14 and 15. A "T" shaped rib 17 is fixedly mounted to the cylindrical housing shank 13 and projects coextensively thereof bisecting the acute included angle 16 and extending coextensively between the first and second housing legs 14 and 15. The "T" shaped rib 17 includes a rib end wall 18*a*, wherein a ground cylinder opening 20 is longitudinally directed interiorly of the rib end wall 17*a* defined by a rib head 21 that is positioned below the first and second legs 14 and 15, with the "T" shaped rib including a rib leg 22 extending coextensively of the rib head 21, with the rib leg 22 defined by generally planar side walls to receive interior walls of the first and second legs as the rib leg 22 projects between the first and second legs 14 and 15 as illustrated in FIGS. 3 and 4 for example.

Figure 6:
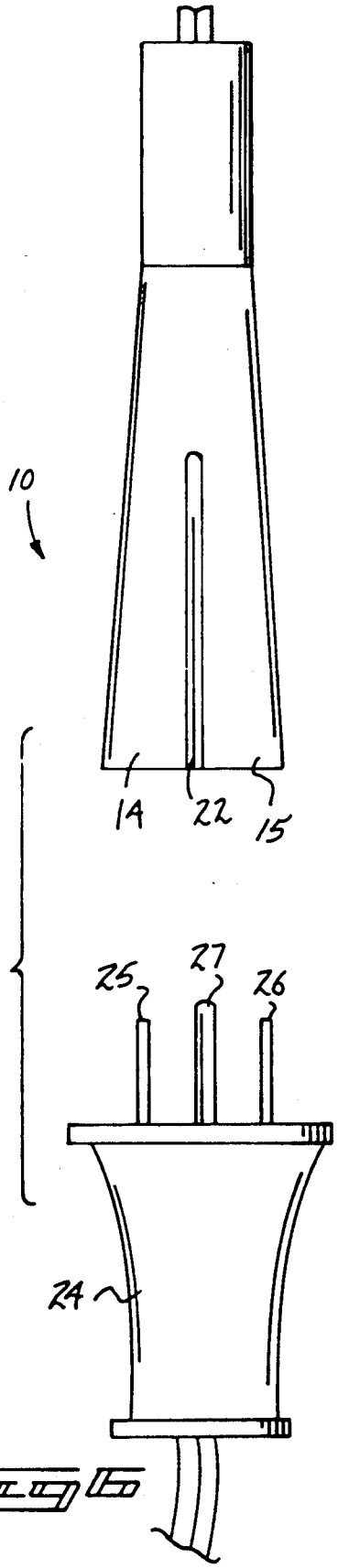
FIG. 6 is an orthographic top view of the invention in a second compressed configuration to accommodate a male plug therewithin.

A first opening channel 18 is directed longitudinally of the first leg 14, with a second opening channel 19 projecting longitudinally of the second leg 15, with the first and second channels in electrical communication with the respective first and second electrical cables 12*a* and 12*b*. A "V" shaped spring 23 is encased within the first and second legs, with an apex of the spring positioned and oriented at a junction of the first and second legs 14 and 15, with each spring leg extending longitudinally of each respective first and second channel adjacent an interior confronting wall of the first and second legs, as illustrated in FIG. 4. The spring 23 assists in biasing the first and second legs in a separated orientation, as illustrated in FIG. 4. To accommodate a receptacle plug member 24 that includes a conventional first and second prong 25 and 26 respectively, and a third cylindrical ground prong 27, the legs 14 and 15 are compressed to a second position, as illustrated in FIG. 6, wherein the first and second legs are in contiguous communication with opposed sides of the rib leg 22. Upon release of the first and second legs, the legs separate to the second position, as illustrated in FIG. 5, to frictionally secure the electrical plug 24 relative to the housing 11.

A modified housing 10*a* is illustrated in FIG. 7 to include a respectively modified first and second slot 28 and 29. A first slot interior wall 30 and a second slot interior wall 31 that are positioned adjacent the respective legs of the spring 23 include projections 32 projecting interiorly of each channel to assist in engagement of the electrical plug connecting prongs. FIG. 9 illustrates a modified electrical plug that includes serrated first and second prongs to enhance engagement of the serrated prongs relative to the projections 32.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An extension cord receptacle, comprising, a unitary "Y" shaped socket housing, the housing including a cylindrical housing shank, the cylindrical housing shank including an electrical transmission line directed interiorly of and coaxially of the cylindrical housing shank, with the electrical transmission line including a first electrical cable and a second electrical cable, and the socket housing further including a respective first and second flexible housing leg, and the first housing leg including a first channel in electrical communication with the first electrical cable, and the second housing leg including a second channel in electrical communication with the second electrical cable, and the first housing leg and the second housing leg secured to the cylindrical housing shank at a junction, and the first housing leg and the second housing leg including biasing means contained within the first housing leg and the second housing leg for biasing the first housing leg and the second housing leg in a separated orientation relative to one another, and the first housing leg and the second housing leg are biased apart in a first position defining an acute included angle therebetween, and the first housing leg and the second housing leg including a "T" shaped rib extending coextensively of the first housing leg and the second housing leg and extending between and coextensively of the first housing leg and the second housing leg bisecting the acute included angle, with the "T" shaped rib secured to the cylindrical shank at the junction, and the "T" shaped rib includes a rib head member oriented below the first housing leg and the second housing leg, wherein the rib head member includes a cylindrical channel directed longitudinally of the rib head member for receiving a ground plug therewithin, and the rib head member including a rib leg, the rib leg including planar side walls and extending coextensively of the rib head and coextensively of the first housing leg and the second housing leg medially thereof, with the planar side walls including a first side wall and a second side wall, with the first side wall in confrontation with the first housing leg, and the second side wall in confrontation with the second housing leg, wherein the first and the second leg are displaced to a second position in contiguous communication with the planar side walls for reception of a receptacle plug member within the first and second channels, and a "V" shaped spring, the "V" shaped spring including a "V" shaped spring apex positioned within the housing at the junction, and the "V" shaped spring including a first spring leg and a second spring leg, the first spring leg positioned interiorly of the first housing leg and the second spring leg positioned interiorly of the second housing leg to normally bias the first housing leg in a spaced relationship relative to the second housing leg to the first position, and the first channel includes a first channel interior side wall adjacent the first spring leg, and the second channel including a second channel side wall adjacent the second spring leg, wherein the first channel interior side wall and the second channel interior side wall include spaced projections fixedly mounted within the first interior side wall and the second interior side wall to engage a respective first and second prong of the electrical plug.

* * * * *